US010539302B1

(12) United States Patent
Chen

(10) Patent No.: US 10,539,302 B1
(45) Date of Patent: Jan. 21, 2020

(54) LAMP AND ASSEMBLING TECHNOLOGY THEREOF

(71) Applicant: Adision Lighting (HK) Co., Limited, Dongguan, Guangdong Province (CN)

(72) Inventor: Bo Chen, Dongguan (CN)

(73) Assignee: Adision Lighting (HK) Co., Limited, Guangdong Province (CN)

( * ) Notice: Subject to any disclaimer, the term of this patent is extended or adjusted under 35 U.S.C. 154(b) by 16 days.

(21) Appl. No.: 16/026,134

(22) Filed: Jul. 3, 2018

(51) Int. Cl.

| | |
|---|---|
| ***F21V 17/00*** | (2006.01) |
| ***F21V 17/02*** | (2006.01) |
| ***F21V 29/70*** | (2015.01) |
| ***F21V 15/01*** | (2006.01) |
| ***F21V 23/00*** | (2015.01) |
| ***F21V 21/04*** | (2006.01) |
| ***F21V 5/04*** | (2006.01) |

(52) U.S. Cl.
CPC ..... *F21V 17/02* (2013.01); *F21V 5/04* (2013.01); *F21V 15/012* (2013.01); *F21V 21/04* (2013.01); *F21V 23/001* (2013.01); *F21V 29/70* (2015.01)

(58) Field of Classification Search
CPC ... F21S 8/026; F21S 8/02; F21S 2/005; F21V 21/044
See application file for complete search history.

(56) References Cited

U.S. PATENT DOCUMENTS

| | | | | |
|---|---|---|---|---|
| 7,198,398 | B2 * | 4/2007 | Buelow, II | F21S 8/02 362/319 |
| 9,447,953 | B2 * | 9/2016 | Lawlor | F21V 21/14 |
| 9,709,220 | B2 * | 7/2017 | Zhang | F21S 8/00 |
| 9,765,951 | B2 * | 9/2017 | Zhang | F21V 23/06 |

* cited by examiner

*Primary Examiner* — Andrew J Coughlin
(74) *Attorney, Agent, or Firm* — Alan D. Kamrath; Mayer & Williams PC

(57) ABSTRACT

A lamp includes a base unit, a light-passing unit, a heat radiator, an electric wire, and a power supply module. The base unit includes a cover and a press ring. The cover includes a bottom plate and a ring-shaped portion. The press ring is connected with the ring-shaped portion. The light-passing unit includes a transparent member, a lens member, a light source pressing member and a light source board. The transparent member is mounted between the cover and the press ring. The lens member is received in the transparent member. The light source pressing member is mounted on the lens member. The light source board is mounted on the light source pressing member. The heat radiator is connected with the transparent member. The electric wire is electrically connected with the light source board and the power supply module.

10 Claims, 5 Drawing Sheets

LAMP AND ASSEMBLING TECHNOLOGY THEREOF

BACKGROUND OF THE INVENTION

1. Field of the Invention

The present invention relates to an illuminating tool and, more particularly, to a lamp and an assembling technology thereof.

2. Description of the Related Art

A ceiling fitting is mounted on the ceiling to provide an illuminating function. A conventional ceiling fitting comprises a housing, a light emitting member mounted in the housing, and a cover mounted on the housing to cover the light emitting member. The housing has a lower end provided with a light channel and an opening. The cover has a lens mounted on the bottom of the housing and aligning with the light channel of the housing to allow passage of light beams. The lens covers the opening of the housing. However, the light emitting member has a fixed irradiating angle that cannot be adjusted according to the user's requirement.

BRIEF SUMMARY OF THE INVENTION

The primary objective of the present invention is to provide a lamp having an adjustable irradiating angle.

In accordance with the present invention, there is provided a lamp comprising a base unit, a light-passing unit, a heat radiator, an electric wire, and a power supply module. The base unit includes a cover and a press ring. The cover includes a bottom plate and a ring-shaped portion. The bottom plate has an annular shape. The bottom plate is fixedly connected with a bottom of the ring-shaped portion. The press ring has a bottom fixedly connected with a top of the ring-shaped portion. The light-passing unit includes a transparent member, a lens member, a light source pressing member and a light source board. The transparent member is mounted between the cover and the press ring. The lens member is received in the transparent member and fixedly connected with the transparent member. The light source pressing member is mounted on a top of the lens member and fixedly connected with the lens member. The light source board is mounted on the light source pressing member. The heat radiator is arranged above the lens member and fixedly connected with the transparent member. The heat radiator has a top provided with a mounting hole, and a wire clip is mounted in the mounting hole of the heat radiator. The electric wire is a DC (direct-current) wire. The electric wire has an output terminal extending through the wire clip and is electrically connected with the light source board. The power supply module has an output terminal electrically connected with an input terminal of the electric wire.

Preferably, the base unit further includes a sponge mat mounted between the press ring and the bottom plate, and the sponge mat is made of EVA (ethylene-vinyl acetate).

Preferably, the sponge mat has a top abutting a bottom of the press ring and has a bottom abutting a top of the bottom plate.

Preferably, the heat radiator has a bottom provided with an external thread, and the transparent member has an interior provided with an internal thread screwed onto the external thread of the heat radiator to connect the heat radiator with the transparent member.

Preferably, the base unit further includes a securing device including a first clamping member and a second clamping member mounted on two opposite sides of the press ring. Each of the first clamping member and the second clamping member has an end provided with an elastic tensile member rotatably connected with the press ring.

Preferably, the press ring is provided with two spring openings, and the elastic tensile member of each of the first clamping member and the second clamping member is rotatably connected with each of the two spring openings of the press ring.

Preferably, the base unit further includes a washer mounted between the transparent member and the press ring.

Preferably, the transparent member is rotatably mounted in the ring-shaped portion and is rotatable relative to the ring-shaped portion through an angle of θ degree, wherein θ degree is ranged between zero degree (0°) and ninety degrees (90°).

An assembling technology of the lamp comprises the following steps:

a first step including assembling the light-passing unit and the heat radiator;

a second step including mounting the ring-shaped portion of the cover on the transparent member of the light-passing unit;

a third step including placing the sponge mat between the press ring and the bottom plate and mounting the press ring on the transparent member, with the top of the sponge mat abutting the bottom of the press ring and with the bottom of the sponge mat abutting the top of the bottom plate;

a fourth step including securing the press ring to the top of the ring-shaped portion by a fastener, to allow the transparent member rotating freely between the ring-shaped portion and the press ring without deflection;

a fifth step including mounting a locking portion of the elastic tensile member of each of the first clamping member and the second clamping member in each of the two spring openings of the press ring, so that the first clamping member and the second clamping member are rotatable upward relative to the press ring to form a substantially V-shaped clamping structure for hanging the lamp; and a sixth step including electrically connecting the input terminal of the electric wire with the output terminal of the power supply module.

Preferably, the first step comprises the following substeps:

a first substep including extending the electric wire through the wire clip from the top of the heat radiator, with the output terminal of the electric wire being electrically connected with an input terminal of the light source board;

a second substep including applying a thermal grease on a bottom of the light source board;

a third substep including securing the light source board on a top of the light source pressing member by a fastener;

a fourth substep including placing the lens member into the transparent member; and a fifth substep including securing the heat radiator in the transparent member by screwing connection.

According to the primary advantage of the present invention, the lower portion of the transparent member is movably mounted on the ring-shaped portion of the cover, and the press ring is mounted on the upper portion of the transparent member, with the bottom of the press ring being fixedly connected with the top of the ring-shaped portion. Thus, the press ring prevents detachment of the transparent member, so that the transparent member is rotatable in the ring-shaped portion through a determined angle, without deflecting the cover, and the light-passing unit has different irradiating angles. In addition, the washer is mounted between the transparent member and the press ring to provide a wearproof function Besides, the washer functions as an adjusting member to facilitate rotation of the transparent member. Preferably, the washer is made of silicone so that the washer is smooth and flexible to prevent the transparent member from being worn due to friction during rotation, thereby enhancing the lifetime of the transparent member. Further, the heat radiator is removably mounted on the transparent member by screwing connection, to facilitate the user replacing the lens member.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
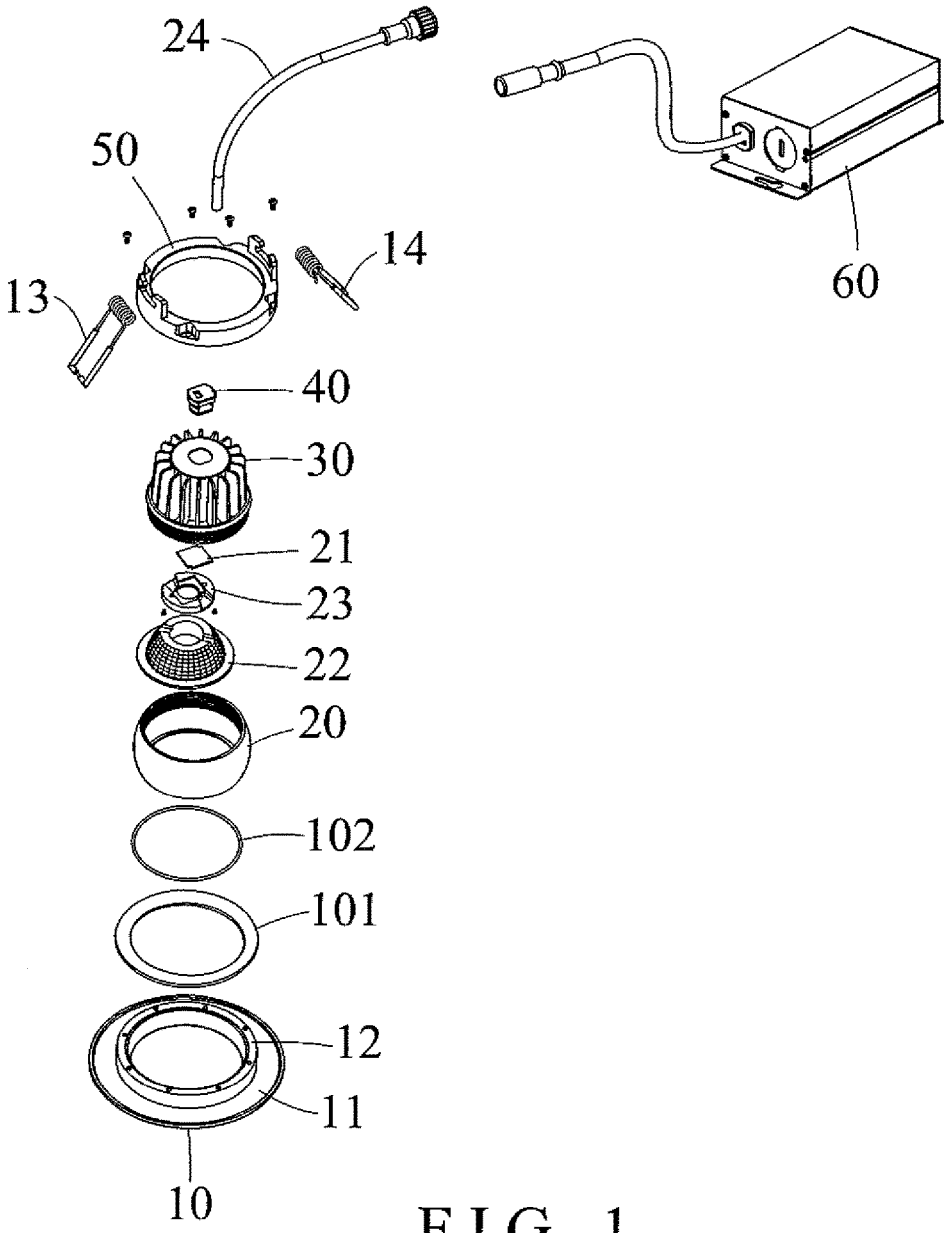
FIG. 1 is an exploded perspective view of a lamp in accordance with the preferred embodiment of the present invention.
Figure 2:
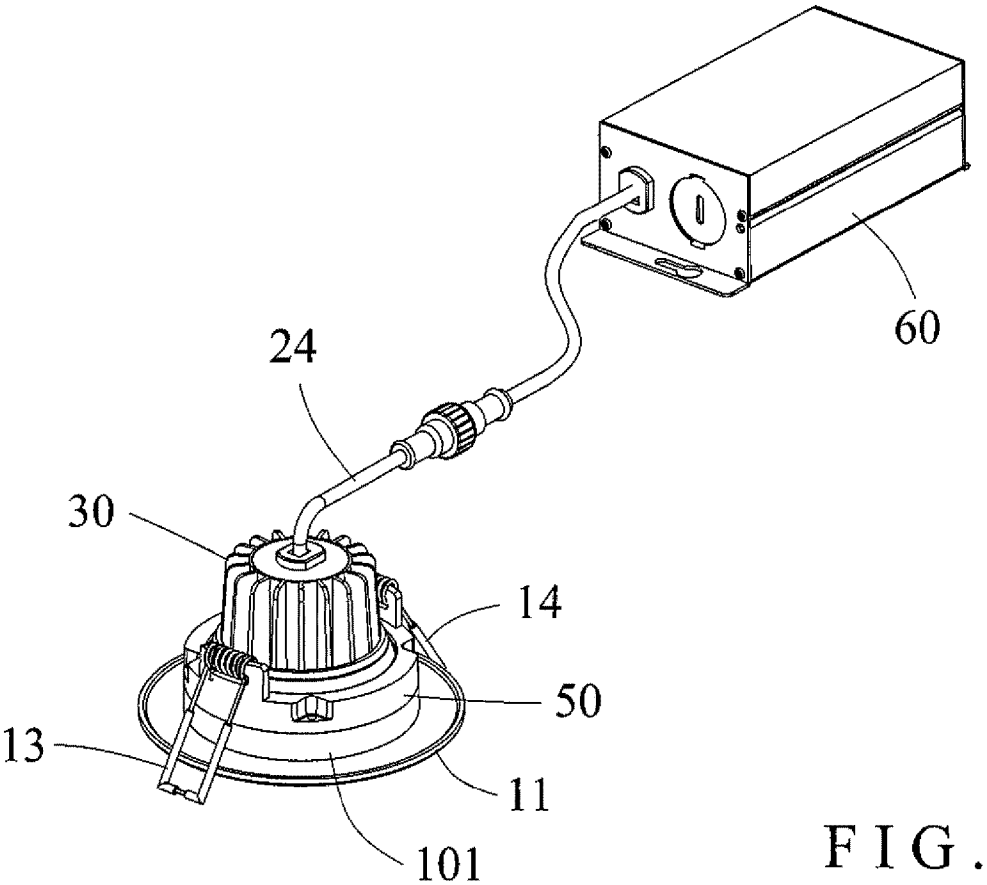
FIG. 2 is a perspective assembly view of the lamp in accordance with the preferred embodiment of the present invention.
Figure 3:
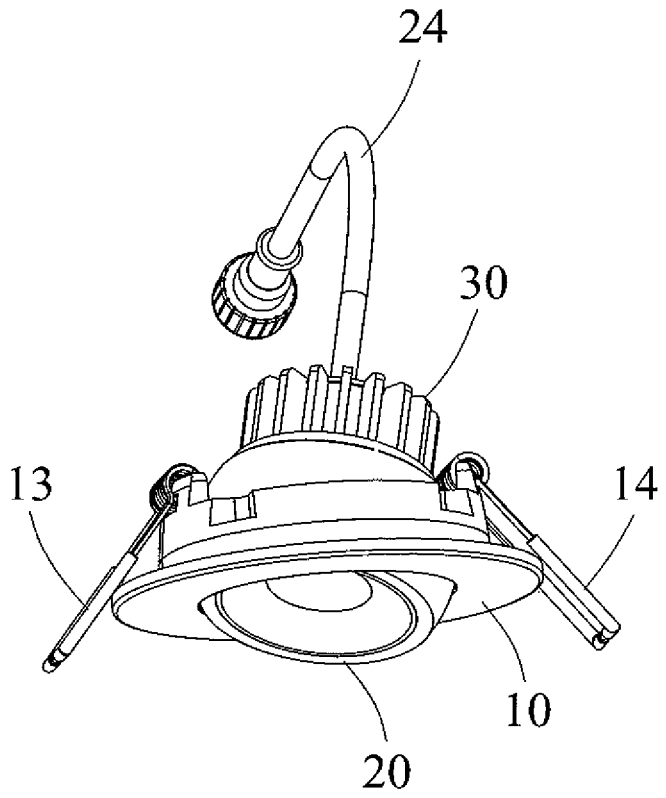
FIG. 3 is another perspective assembly view of the lamp in accordance with the preferred embodiment of the present invention.
Figure 4:
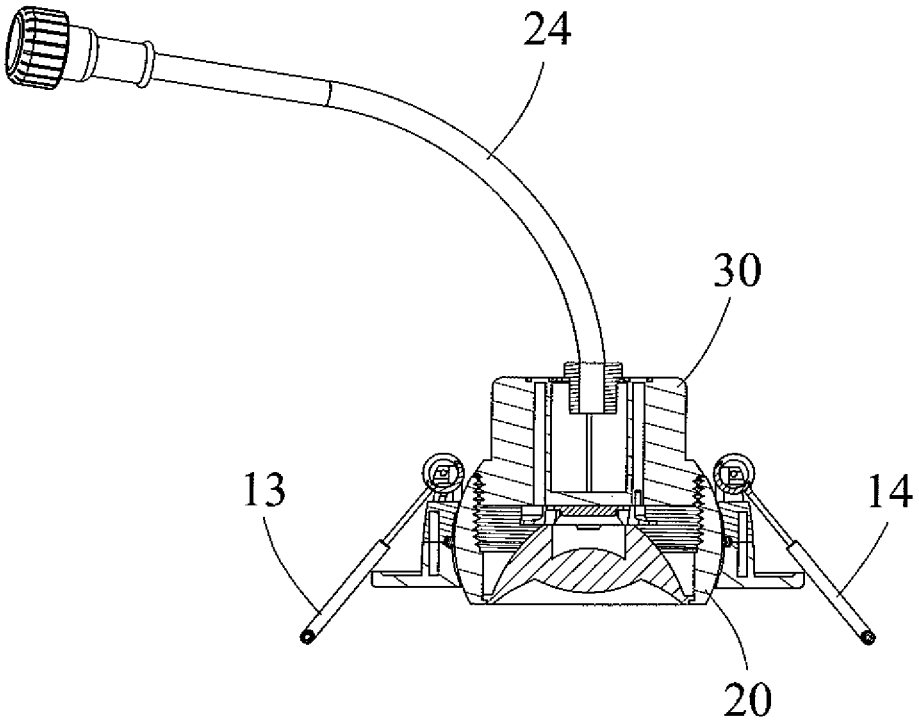
FIG. 4 is a cross-sectional assembly view of the lamp in accordance with the preferred embodiment of the present invention.

Referring to the drawings and initially to FIGS. 1-4, a lamp in accordance with the preferred embodiment of the present invention comprises a base unit, a light-passing unit, a heat radiator 30, an electric wire 24, and a power supply module 60.

The base unit includes a cover 10 and a press ring 50. The cover 10 includes a bottom plate 11 and a ring-shaped portion 12. The bottom plate 11 has an annular shape. The bottom plate 11 is fixedly connected with a bottom of the ring-shaped portion 12. The press ring 50 has a bottom fixedly connected with a top of the ring-shaped portion 12.

The light-passing unit includes a transparent member 20, a lens member 22, a light source pressing member 23 and a light source board 21. The transparent member 20 is mounted between the cover 10 and the press ring 50. The lens member 22 is received in the transparent member 20 and fixedly connected with the transparent member 20. The light source pressing member 23 is mounted on a top of the lens member 22 and fixedly connected with the lens member 22. The light source board 21 is mounted on the light source pressing member 23 and contains a light source.

The heat radiator 30 is used to dissipate the heat produced by the light-passing unit so as to reduce the temperature of the lamp and to enhance the lifetime of the lamp. The heat radiator 30 is arranged above the lens member 22 and fixedly connected with the transparent member 20. The heat radiator 30 has a top provided with a mounting hole, and a wire clip 40 is mounted in the mounting hole of the heat radiator 30.

The electric wire 24 is a DC (direct-current) wire. The electric wire 24 has an output terminal extending through the wire clip 40 and is electrically connected with the light source board 21.

The power supply module 60 has an output terminal electrically connected with an input terminal of the electric wire 24.

In practice, the light-passing unit and the heat radiator 30 are assembled before assembly of the lamp. The electric wire 24 initially extends through the wire clip 40 from the top of the heat radiator 30, with the output terminal of the electric wire 24 being electrically connected with an input terminal of the light source board 21. Then, a thermal grease is applied on a bottom of the light source board 21. Then, the light source board 21 is fixedly connected with a top of the light source pressing member 23 by screws. Then, the lens member 22 is received in the transparent member 20. Finally, the heat radiator 30 is fixedly connected with the transparent member 20. In such a manner, the light-passing unit has a simple structure, and the heat radiator 30 is mounted on the transparent member 20, to facilitate the user replacing the lens member 22.

In the preferred embodiment of the present invention, the base unit further includes a sponge mat 101 mounted between the press ring 50 and the bottom plate 11 to reduce the friction and to provide a vibration-proof function. Preferably, the sponge mat 101 is made of EVA (ethylene-vinyl acetate).

In the preferred embodiment of the present invention, the sponge mat 101 has a top abutting a bottom of the press ring 50 and has a bottom abutting a top of the bottom plate 11.

In the preferred embodiment of the present invention, the heat radiator 30 has a bottom provided with an external thread, and the transparent member 20 has an interior provided with an internal thread screwed onto the external thread of the heat radiator 30 to connect the heat radiator 30 with the transparent member 20.

In the preferred embodiment of the present invention, the base unit further includes a securing device including a first clamping member 13 and a second clamping member 14 mounted on two opposite sides of the press ring 50. Each of the first clamping member 13 and the second clamping member 14 has an end provided with an elastic tensile member rotatably connected with the press ring 50. Preferably, the elastic tensile member of each of the first clamping member 13 and the second clamping member 14 is a spring or a resilient cord.

In the preferred embodiment of the present invention, the press ring 50 is provided with two spring openings, and the elastic tensile member of each of the first clamping member 13 and the second clamping member 14 is rotatably connected with each of the two spring openings of the press ring 50.

In the preferred embodiment of the present invention, the base unit further includes a washer 102 mounted between the transparent member 20 and the press ring 50 to provide a wearproof function. In addition, the washer 102 also functions as an adjusting member to facilitate rotation of the transparent member 20. Preferably, the washer 102 is made of silicone.

In the preferred embodiment of the present invention, the transparent member 20 is rotatably mounted in the ring-shaped portion 12 and is rotatable relative to the ring-shaped portion 12 through an angle of θ degree, wherein θ degree is ranged between zero degree (0°) and ninety degrees (90°).

In the preferred embodiment of the present invention, the cover 10 is mounted on the light-passing unit, and the press ring 50 is mounted on the Light-passing unit. Preferably, each of the bottom plate 11, the ring-shaped portion 12 and the press ring 50 has an interior provided with an arcuate face. Thus, the press ring 50 prevents displacement or detachment of the light-passing unit, so that the transparent member 20 is rotatable in the ring-shaped portion 12 through the degree of θ, without deflecting the cover 10. In such a manner, the light-passing unit has different irradiating angles.

In the preferred embodiment of the present invention, the transparent member 20 has an annular shape and has an exterior provided with an arcuate face mounted between the arcuate face of the cover 10 and the arcuate face of the press ring 50.

Figure 5:
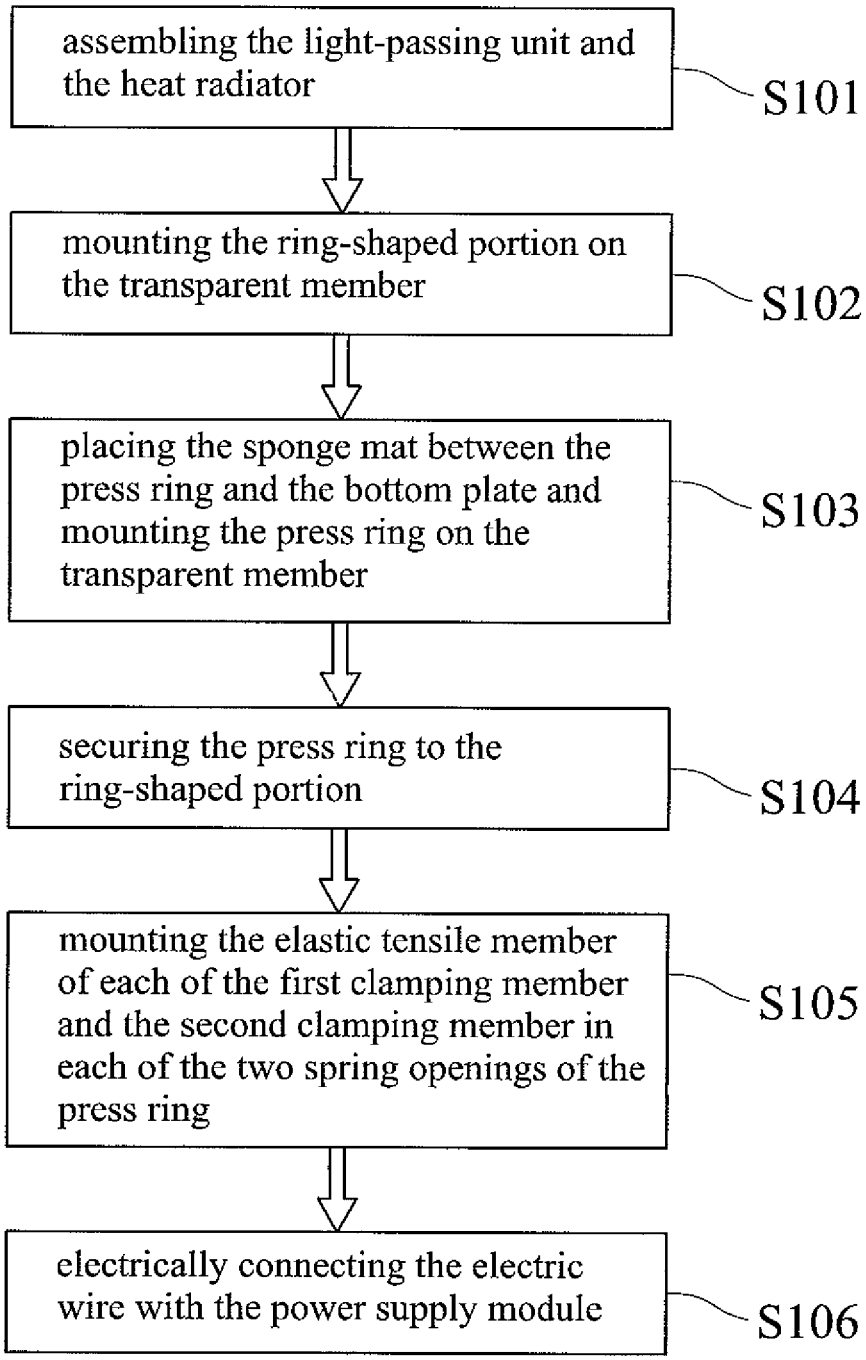
FIG. 5 is a flow chart showing an assembling technology of the lamp in accordance with the preferred embodiment of the present invention.

Referring now to FIG. 5 with reference to FIGS. 1-4, an assembling technology of the lamp in accordance with the preferred embodiment of the present invention comprises the following steps:

a first step S101 including assembling the light-passing unit and the heat radiator 30;

a second step S102 including mounting the ring-shaped portion 12 of the cover 10 on the transparent member 20 of the light-passing unit;

a third step S103 including placing the sponge mat 101 between the press ring 50 and the bottom plate 11 and mounting the press ring 50 on the transparent member 20, with the top of the sponge mat 101 abutting the bottom of the press ring 50 and with the bottom of the sponge mat 101 abutting the top of the bottom plate 11;

a fourth step S104 including securing the press ring 50 to the top of the ring-shaped portion 12 by a fastener, to allow the transparent member 20 rotating freely between the ring-shaped portion 12 and the press ring 50 without deflection;

a fifth step S105 including mounting a locking portion of the elastic tensile member of each of the first clamping member 13 and the second clamping member 14 in each of the two spring openings of the press ring 50, so that the first clamping member 13 and the second clamping member 14 are rotatable upward relative to the press ring 50 to form a substantially V-shaped clamping structure for hanging the lamp; and a sixth step S106 including electrically connecting the input terminal of the electric wire 24 with the output terminal of the power supply module 60.

The first step S101 comprises the following substeps:

a first substep including extending the electric wire 24 through the wire clip 40 from the top of the heat radiator 30, with the output terminal of the electric wire 24 being electrically connected with an input terminal of the light source board 21;

a second substep including applying a thermal grease on a bottom of the light source board 21;

a third substep including securing the light source board 21 on a top of the light source pressing member 23 by a fastener;

a fourth substep including placing the lens member 22 into the transparent member 20; and a fifth substep including securing the heat radiator 30 in the transparent member 20 by screwing connection.

In conclusion, the lower portion of the transparent member 20 is movably mounted on the ring-shaped portion 12 of the cover 10, the press ring 50 is mounted on the upper portion of the transparent member 20, and the bottom of the press ring 50 is fixedly connected with the top of the ring-shaped portion 12. Thus, the press ring 50 prevents detachment of the transparent member 20, so that the transparent member 20 is rotatable in the ring-shaped portion 12 through a determined angle, without deflecting the cover 10, and the light-passing unit has different irradiating angles. In addition, the washer 102 is mounted between the transparent member 20 and the press ring 50 to provide a wearproof function Besides, the washer 102 also functions as an adjusting member to facilitate rotation of the transparent member 20. Preferably, the washer 102 is made of silicone so that the washer 102 is smooth and flexible to prevent the transparent member 20 from being worn due to friction during rotation, thereby enhancing the lifetime of the transparent member 20. Further, the heat radiator 30 is removably mounted on the transparent member 20 by screwing connection, to facilitate the user replacing the lens member 22.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A lamp comprising:

a base unit, a light-passing unit, a heat radiator, an electric wire, and a power supply module;

wherein:

the base unit includes a cover and a press ring;

the cover includes a bottom plate and a ring-shaped portion;

the bottom plate has an annular shape;

the bottom plate is fixedly connected with a bottom of the ring-shaped portion;

the press ring has a bottom fixedly connected with a top of the ring-shaped portion;

the light-passing unit includes a transparent member, a lens member, a light source pressing member and a light source board;

the transparent member is mounted between the cover and the press ring;

the lens member is received in the transparent member and fixedly connected with the transparent member;

the light source pressing member is mounted on a top of the lens member and fixedly connected with the lens member;

the light source board is mounted on the light source pressing member;

the heat radiator is arranged above the lens member and fixedly connected with the transparent member;

the heat radiator has a top provided with a mounting hole;

a wire clip is mounted in the mounting hole of the heat radiator;

the electric wire is a DC (direct-current) wire;

the electric wire has an output terminal extending through the wire clip and is electrically connected with the light source board; and the power supply module has an output terminal electrically connected with an input terminal of the electric wire.

2. The lamp of claim 1, wherein the base unit further includes a sponge mat mounted between the press ring and the bottom plate, and the sponge mat is made of EVA (ethylene-vinyl acetate).

3. The lamp of claim 2, wherein the sponge mat has a top abutting a bottom of the press ring and has a bottom abutting a top of the bottom plate.

4. The lamp of claim 3, wherein the heat radiator has a bottom provided with an external thread, and the transparent member has an interior provided with an internal thread screwed onto the external thread of the heat radiator to connect the heat radiator with the transparent member.

5. The lamp of claim 4, wherein:

the base unit further includes a securing device including a first clamping member and a second clamping member mounted on two opposite sides of the press ring; and each of the first clamping member and the second clamping member has an end provided with an elastic tensile member rotatably connected with the press ring.

6. The lamp of claim 5, wherein the press ring is provided with two spring openings, and the elastic tensile member of each of the first clamping member and the second clamping member is rotatably connected with each of the two spring openings of the press ring.

7. The lamp of claim 6, wherein an assembling technology of the lamp comprises the following steps:

a first step including assembling the light-passing unit and the heat radiator;

a second step including mounting the ring-shaped portion of the cover on the transparent member of the light-passing unit;

a third step including placing the sponge mat between the press ring and the bottom plate and mounting the press ring on the transparent member, with the top of the sponge mat abutting the bottom of the press ring and with the bottom of the sponge mat abutting the top of the bottom plate;

a fourth step including securing the press ring to the top of the ring-shaped portion by a fastener, to allow the transparent member rotating freely between the ring-shaped portion and the press ring without deflection;

a fifth step including mounting a locking portion of the elastic tensile member of each of the first clamping member and the second clamping member in each of the two spring openings of the press ring, so that the first clamping member and the second clamping member are rotatable upward relative to the press ring to form a substantially V-shaped clamping structure for hanging the lamp; and a sixth step including electrically connecting the input terminal of the electric wire with the output terminal of the power supply module.

8. The lamp of claim 7, wherein the first step comprises the following substeps:

a first substep including extending the electric wire through the wire clip from the top of the heat radiator, with the output terminal of the electric wire being electrically connected with an input terminal of the light source board;

a second substep including applying a thermal grease on a bottom of the light source board;

a third substep including securing the light source board on a top of the light source pressing member by a fastener;

a fourth substep including placing the lens member into the transparent member; and a fifth substep including securing the heat radiator in the transparent member by screwing connection.

9. The lamp of claim 1, wherein the base unit further includes a washer mounted between the transparent member and the press ring.

10. The lamp of claim 1, wherein the transparent member is rotatably mounted in the ring-shaped portion and is rotatable relative to the ring-shaped portion through an angle of θ degree, wherein θ degree is ranged between zero degree (0°) and ninety degrees (90°).

* * * * *